US006481421B1

(12) United States Patent
Reiter

(10) Patent No.: US 6,481,421 B1
(45) Date of Patent: Nov. 19, 2002

(54) COMPENSATING ELEMENT

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/914,328

(22) PCT Filed: Dec. 22, 2000

(86) PCT No.: PCT/DE00/04623

§ 371 (c)(1),
(2), (4) Date: Dec. 10, 2001

(87) PCT Pub. No.: WO01/48370

PCT Pub. Date: Jul. 5, 2001

(30) Foreign Application Priority Data

Dec. 24, 1999 (DE) ..... 199 62 968

(51) Int. Cl.[7] ..... F02M 37/04
(52) U.S. Cl. ..... 123/470
(58) Field of Search ..... 123/470

(56) References Cited

U.S. PATENT DOCUMENTS 3,334,617 A * 8/1967 Palkowsky ..... 123/470
4,528,959 A 7/1985 Hauser, Jr.
4,625,682 A * 12/1986 Dietrich et al. ..... 123/41.31
6,009,856 A * 1/2000 Smith, III et al. ..... 123/470
6,186,123 B1 * 2/2001 Maier et al. ..... 123/470
6,196,195 B1 * 3/2001 Trutschel et al. ..... 123/470

FOREIGN PATENT DOCUMENTS

DE 197 35 665 1/1999
DE 197 43 103 4/1999

* cited by examiner

*Primary Examiner*—Thomas N. Moulis
(74) *Attorney, Agent, or Firm*—Kenyon & Kenyon

(57) ABSTRACT

A compensating element for a fuel injector, which can be inserted into a receiving borehole of a cylinder head of an internal combustion engine, in order to directly inject fuel into the combustion chamber of the internal combustion engine, has a compensating sleeve; a connecting segment of the compensating sleeve being attachable to a housing segment of the fuel injector. The compensating element is supported in the receiving borehole of the cylinder head, by a support segment of the compensating sleeve; and a flexible segment is provided between the connecting segment and the support segment.

12 Claims, 2 Drawing Sheets

3

COMPENSATING ELEMENT

FIELD OF THE INVENTION

The present invention relates to a compensating element.

BACKGROUND INFORMATION

A thermal protection sleeve is described in German Published Patent Application No. 197 43 103, which encircles a fuel injector at a nozzle body. The thermal protection sleeve is inserted into a stepped receiving borehole of a cylinder head of an internal combustion engine, and circumferentially surrounds an ejection-side nozzle body segment of a fuel injector inserted into the receiving borehole. One end of the thermal protection sleeve has a collar, which rests against a step of the receiving borehole. In addition, the ejection-side end of the thermal protection sleeve has a folded section, which renders a certain length of the sleeve double-layered. In this region, the sleeve is radially locked between the nozzle body and the bore in the cylinder head. Since a tapered segment of the thermal protection sleeve, against which a correspondingly tapered segment of the fuel injector rests, is adjacent to the double-layered segment in the direction of the fuel supply line of the fuel injector, a certain transfer of axial force from the nozzle body of the fuel injector to the thermal protection sleeve is possible. However, this does not at all allow one to adjust the tolerances of the position of the fuel injector in the receiving borehole.

A fuel injection system having a compensating element is described in German Published Patent Application No. 197 35 665, the compensating element being made of a supporting body which has a dome-shaped supporting surface. A fuel injector is supported by this compensating element, in a receiving borehole of a cylinder head. Since the supporting surface of the fuel injector rests on the spherically shaped surface, the fuel injector can be mounted at an angle deviating from the axis of the receiving hole by up to a certain amount, and can be pressed firmly into the receiving borehole by a suitable device, e.g. a clamping shoe. This allows for a simple adaptation to the fuel supply lines. Thus, one can compensate for tolerances during manufacturing and mounting.

However, it is disadvantageous that the supporting body is expensive to manufacture and requires a precisely manufactured, spherical surface. In addition, it cannot be preassembled with the fuel injector during installation, and the two cannot be inserted as a unit.

The variant proposed in German Published Patent Application No. 197 35 665, of forming the spherical surface on the cylinder head itself and thus, obviating a separate component part, has the disadvantage that the spherical surface requiring a high degree of accuracy must be formed in a bore, at the relatively large workpiece for the entire cylinder head. Therefore, this has disadvantages from the standpoint of production engineering.

German Published Patent Application No. 197 35 665 also proposes an intermediate piece on the inlet side of a fuel injector, in order to compensate for tolerances with respect to the axes of the fuel injector and a fuel-outlet orifice of a fuel-intake manifold. In this context, a nozzle body of the fuel injector is inserted into a receiving borehole of a cylinder head, and is held by a suitable retaining device, e.g. a clamping shoe, which means that the position of the fuel-injector axis is preselected. A possible, axial offset between the axis of the fuel injector and the axis of the fuel-outlet orifice of the fuel-intake manifold is compensated for by tilting the intermediate piece disposed between the axes. In each case, this is sealed by a sealing ring in the direction of the fuel-intake manifold, as well as in the direction of the fuel injector.

It is disadvantageous to have the additional expenditure associated with having several more components, and to have the additional number of connections to be sealed. Since the intermediate piece requires an increased overall height, it can only be designed to be relatively short. This results in the need for the intermediate piece to already be at a relatively large angle to the axes, when the axial offset to be adjusted is small. However, in the case of bending, the sealing ring's seal between the fuel injector and the intermediate piece, on one hand, and between the fuel-outlet orifice and the intermediate piece, on the other hand, is only based on the elasticity of the specific sealing ring. Therefore, there is the danger of the sealing rings not being uniformly compressed between the respective sealing surfaces, when the angle is too large. This can result in leakage.

SUMMARY OF THE INVENTION

In contrast, the compensating element of the present invention allows the fuel injector to be tilted with respect to the axis of the receiving borehole, over a relatively large angular range. In addition, the compensating element of the present invention is simple and inexpensive to manufacture. Furthermore, the compensating element transmits the axial force between the fuel injector and the receiving borehole in the cylinder head, the receiving borehole supporting the fuel injector in opposition to the retention force holding it in place. Therefore, the retention force and the position of the fuel injector can easily be adjusted, since the compensating element advantageously deflects in a flexible manner.

Therefore, the use of a compensating element designed according to the present invention allows for relatively large manufacturing tolerances in the manufacture of the cylinder head, as well as in the manufacture of the fuel injector and the fuel-intake manifold.

The compensating sleeve of the compensating element is advantageously in the form of a corrugated tube. This is easy to manufacture and allows both a large degree of longitudinal adjustment, and extensive tilting or bending along its longitudinal axis.

If the compensating element is supported at a conical step of the fuel injector, by an endface that is conical as well, then the axial retention force is consequently transmitted to the compensating element in an advantageous manner. In the case in which an angle exists between the axis of the fuel injector and the axis of the receiving borehole, the flexible segment is accordingly compressed on one side, until the conical end face makes uniform contact.

The compensating element advantageously has a sealing ring, which is situated between a step of the receiving borehole and a preformed shoulder of the support segment. Since the contact pressure of the seal is produced by the axial retaining force holding down the fuel injector and compensating element in the borehole, and not by radially squeezing a sealing ring in a borehole, the unit made of the fuel injector and compensating element can therefore be easily assembled and disassembled. The compression of the seal can be advantageously limited by a radial support ring, which surrounds the sealing ring on the outside.

The compensating element can be simplified in an advantageous manner, when a radially outward corrugation of the compensating sleeve, which in the form of a corrugated tube, is used as a preformed shoulder.

The service life of the compensating element can be increased in an advantageous manner, when a heat-resistant elastomer, Teflon®, or graphite is used for the sealing ring, between the support segment and the receiving borehole.

A higher compressibility and bendability, especially of the flexible segment, can be attained using the same dimensions, when spring steel is used for manufacturing the compensating sleeve.

An advantageous design of the compensating element according to the present invention is achieved, when the diameter of the connecting segment is dimensioned to form an interference fit with the corresponding segment of the fuel injector, when small forces are applied. On one hand, the compensating element can still be slid easily onto the nozzle body, but on the other hand, it forms a preassembled unit with the fuel injector, without any special fastener, the unit already including all of the seals, as well. This simplifies the installation of the fuel injector.

DETAILED DESCRIPTION

Figure 1:
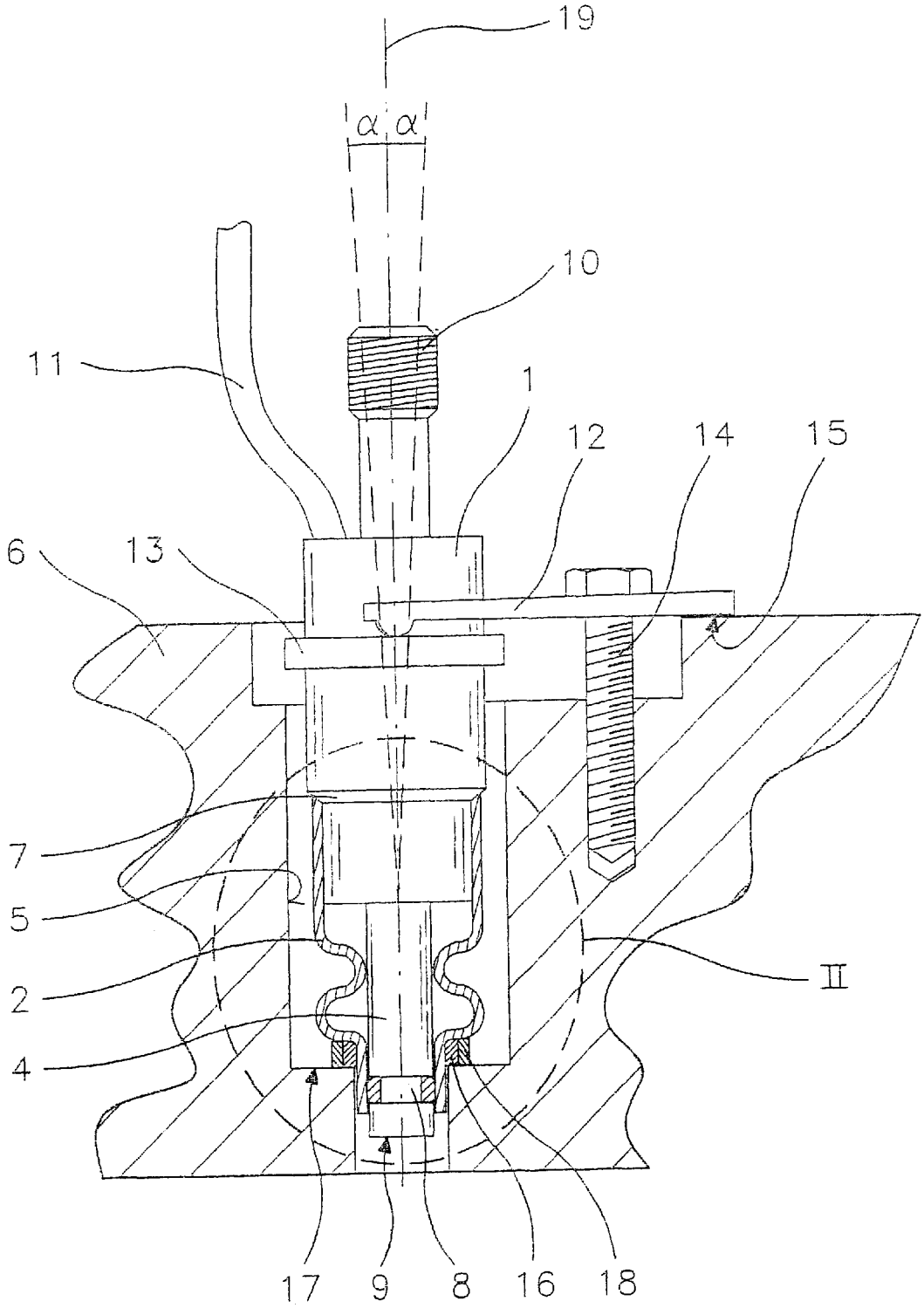
FIG. 1 shows a fuel injector inserted into a cylinder head along with a compensating element of the present invention, a sectional view of the compensating element and the cylinder head being represented.

FIG. 1 shows a partial section of a fuel injector 1 having a compensating element 2 of the present invention. Fuel injection valve 1 is used to inject fuel in a mixture-compressing, spark-ignition engine. The represented valve is a high-pressure injection valve for the direct injection of fuel into combustion chamber 3 of the internal combustion engine. However, compensating element 2 of the present invention can also be used in other cases.

Fuel injector 1 includes a nozzle body 4 having an ejection-side end 9, and is mounted in a receiving borehole 5 of a cylinder head 6, whose sectional view is indirectly shown. The drawing also shows a first sealing ring 8, which provides a seal between nozzle body 4 and compensating element 2, and may be made out of Teflon®. At fuel injector 1, the drawing also shows a fuel inlet 10 and a control line 11 for electrically controlled fuel injector 1, which is exemplarily provided here.

Fuel injector 1 is held in receiving borehole 5 by a clamping shoe 12, which presses on a flange 13 on nozzle body 4 of fuel injector 1. Clamping shoe 12 is pulled against cylinder head 6 by a screw 14, whose applied retention force can be adjusted, the clamping shoe being supported on a step 15 of cylinder head 6.

Compensating element 2 also has a second sealing ring 16, of which a sectional view is shown, and which is above a step 17 of receiving borehole 5. Second sealing ring 16 is surrounded on the outside by a radially situated support ring 18, of which a sectional view is also shown.

For purposes of illustrating the tilt of fuel injector 1 for adjusting tolerances, axis of symmetry 19 of fuel injector 1 is included along with the tilt angle $\alpha$ that is possible in each case. Even in the case of manufacturing tolerances, this tilting allows for a connection to the rigid fuel-intake manifold not represented here.

Figure 2:
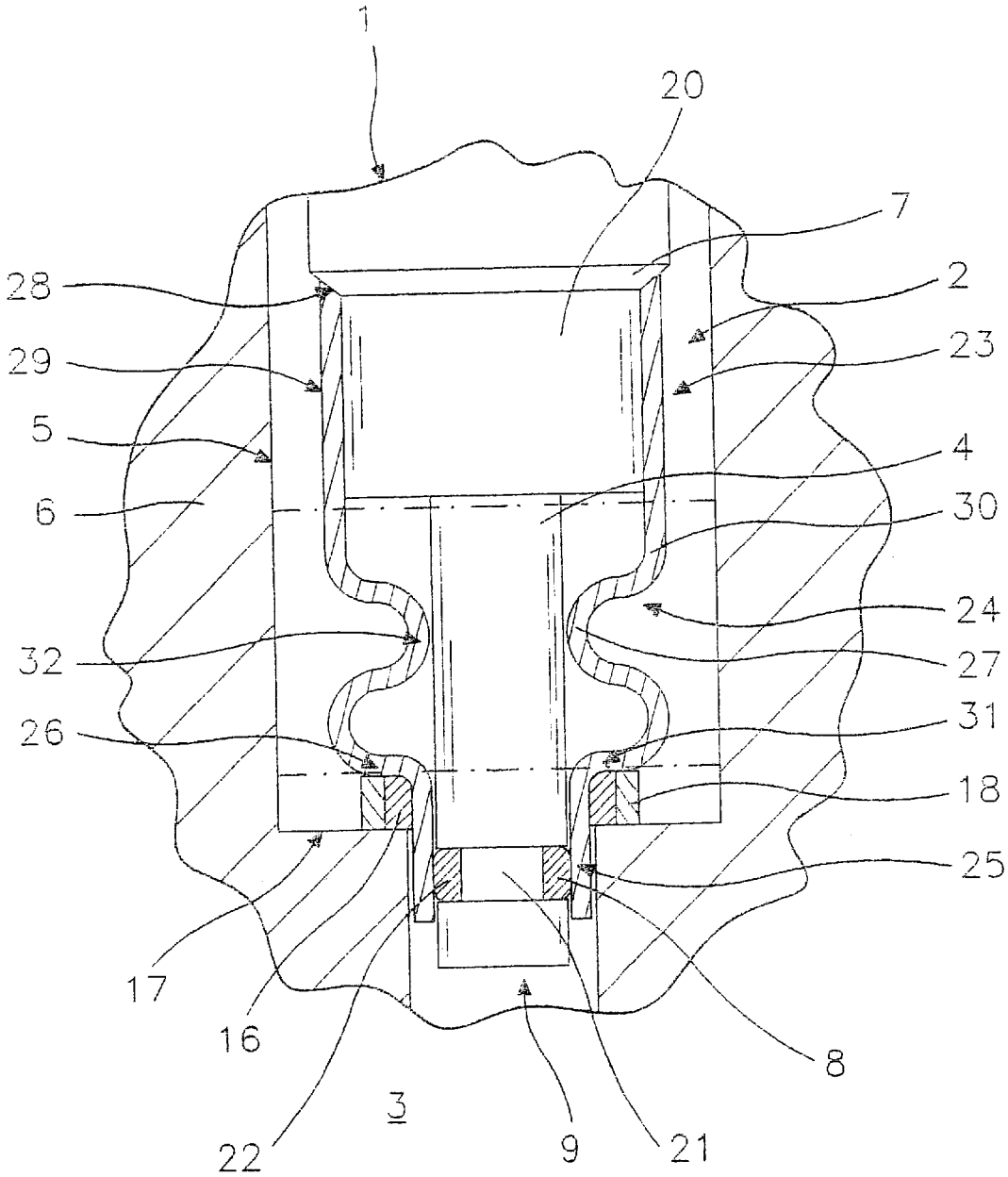
FIG. 2 shows an enlarged view of detail II in FIG. 1.

FIG. 2 shows an enlarged view of detail II in FIG. 1. Nozzle body 4, a larger-diameter housing segment 20 of fuel injector 1, and a conical step 7 of fuel injector 1 are represented. In addition, fuel injector 1 has a slot 21 above ejection-side end 9 of nozzle body 4; first sealing ring 8, of which a sectional view is shown, being disposed in the slot. Compensating element 2 includes a compensating sleeve 30, which is subdivided into the three segments connecting segment 23, flexible segment 24, and support segment 25. In this context, the lines indicated by dots and dashes only show the separating lines in an approximate manner.

Provided in support segment 25 is second sealing ring 16, which is surrounded on the outside by radial support ring 18. This second sealing ring 16 is situated between step 17 of receiving borehole 5, and a first, radially outward corrugation 26, which forms a shoulder 31. In adjacent, flexible segment 24, compensating sleeve 30 is designed as a corrugated tube 27, in that a second, radially inward corrugation 32 directed at nozzle body 4 follows first, radially outward corrugation 26, in the direction of connecting segment 23.

Connecting segment 23 of compensating sleeve 30 has a conical end face 28, which rests against conical step 7 of fuel injector 1. As an example, the dimensions of housing segment 20 of nozzle body 4 and the dimensions of connecting segment 23 of compensating sleeve 30 are selected to create a press fit between these two partners.

Therefore, compensating element 2 can be mated with fuel injector 1 in an advantageous manner, to form a preassembled unit. No other parts need to be added during final assembly; in particular, second sealing ring 16 and support ring 18 are already included. Upon tightening clamping shoe 12, the higher compression on one side of flexible segment 24 causes fuel injector 1 to automatically adjust itself to the tilt angle within the framework of the possible tilt angle $\alpha$, so that fuel inlet 10 is connected in a stress-free manner, to the fuel-intake manifold not shown here.

By tightening clamping shoe 12 further, using screw 14, flexible segment 24 can also be compressed to greater degree, and a possible difference in height can be compensated for.

It is likewise advantageous, that compensating element 2 protects fuel injector 1 from excessive heating, since there is an air space between nozzle body 4 and compensating element 2, especially in flexible segment 24.

What is claimed is:

1. A compensating element for a fuel injector that can be inserted into a receiving borehole of a cylinder head of an internal combustion engine in order to directly inject a fuel into a combustion chamber of the internal combustion engine, the compensating element comprising:

a compensating sleeve including:

a connecting segment that is attachable to a housing segment of the fuel injector, a support segment for supporting the compensating element in the receiving borehole of the cylinder head, and a flexible segment provided between the connecting segment and the support segment.

2. The compensating element according to claim 1, wherein:

the flexible segment includes a corrugated tube.

3. The compensating element according to claim 1, wherein:

the compensating sleeve is supported by a conical end face at a conical step of the fuel injector.

4. The compensating element according to claim 1, further comprising:

a first sealing ring for sealing the compensating sleeve from the fuel injector, between the support segment and the fuel injector.

5. The compensating element according to claim 1, wherein:

the compensating sleeve includes a circumferentially formed radial shoulder at the support segment, and a second sealing ring is provided between the shoulder and a step of the receiving borehole.

6. The compensating element according to claim 5, further comprising:

a support ring for limiting an axial compression of the second sealing ring and being positioned radially outwards around the second sealing ring.

7. The compensating element according to claim 6, wherein:

the support segment is supported at the step of the receiving borehole by the support ring.

8. The compensating element according to claim 5, wherein:

the shoulder is formed by a first, radially outward corrugation of the compensating sleeve that is in the form of a corrugated tube.

9. The compensating element according to claim 8, wherein:

the compensating sleeve in the form of the corrugated tube includes a second, radially inward corrugation.

10. The compensating element according to claim 5, wherein:

the second sealing ring includes one of a heat-resistant elastomer, Teflon®, and graphite.

11. The compensating element according to claim 1, wherein:

the compensating sleeve includes spring steel.

12. The compensating element according to claim 1, wherein:

a diameter of the connecting segment and a diameter of the housing segment of the fuel injector are matched to form a press fit.

* * * * *